United States Patent [19]

Schaaf et al.

[11] Patent Number: 4,479,740

[45] Date of Patent: Oct. 30, 1984

[54] EROSION CONTROL DEVICE AND METHOD OF MAKING AND INSTALLING SAME

[75] Inventors: Cecil F. Schaaf, Standish; Russell J. McIntosh, Flushing, both of Mich.

[73] Assignee: Paul A. Kakuris, Chicago, Ill.

[21] Appl. No.: 375,555

[22] Filed: May 6, 1982

Related U.S. Application Data

[63] Continuation of Ser. No. 68,347, Aug. 21, 1979, abandoned, which is a continuation of Ser. No. 906,105, May 15, 1978, abandoned, and Ser. No. 770,801, Feb. 22, 1977, abandoned.

[51] Int. Cl.[3] ..... E02B 3/04

[52] U.S. Cl. ..... 405/30; 405/33

[58] Field of Search ..... 405/30, 33, 273, 21, 405/25, 29

[56] References Cited

U.S. PATENT DOCUMENTS

| | | | |
|---|---|---|---|
| 905,596 | 12/1908 | Smith . | |
| 1,277,829 | 9/1918 | Baum . | |
| 2,191,924 | 2/1940 | Humphrey . | |
| 2,474,786 | 6/1949 | Humphrey . | |
| 2,653,450 | 9/1953 | Fort . | |
| 2,755,631 | 7/1956 | Hayden . | |
| 3,011,316 | 12/1961 | Hibarker . | |
| 3,118,282 | 1/1964 | Jarlan | 405/31 |
| 3,176,468 | 4/1965 | Nagai et al. . | |
| 3,252,287 | 5/1966 | Sukuki . | |
| 3,280,569 | 2/1964 | Wosenitz . | |
| 3,282,054 | 11/1966 | Saginor . | |
| 3,357,192 | 12/1967 | Hibarger . | |
| 3,386,250 | 6/1968 | Katayama . | |
| 3,386,252 | 6/1968 | Nilson . | |
| 3,479,824 | 11/1969 | Schaaf et al. | 405/33 |
| 3,597,928 | 8/1971 | Pilaar . | |
| 3,844,125 | 10/1974 | Williams . | |
| 3,875,750 | 4/1975 | Campbell . | |
| 3,897,397 | 7/1975 | Fair | 405/33 |
| 3,913,333 | 10/1975 | Hubbard . | |
| 4,129,006 | 12/1978 | Payne . | |

FOREIGN PATENT DOCUMENTS

| | | | |
|---|---|---|---|
| 730189 | 8/1932 | France . | |
| 576047 | 5/1976 | Switzerland | 405/25 |
| 1695 | of 1882 | United Kingdom . | |
| 769861 | 6/1955 | United Kingdom . | |
| 915057 | 1/1963 | United Kingdom . | |

*Primary Examiner*—Alexander Grosz

*Attorney, Agent, or Firm*—Willian Brinks Olds Hofer Gilson & Lione Ltd.

[57] ABSTRACT

An erosion control structure having a plurality of undivided flow passages. The structure may be constructed from concrete block bonded together, a single cast module, a plurality of pipes bonded together or other suitable construction materials.

8 Claims, 5 Drawing Figures

EROSION CONTROL DEVICE AND METHOD OF MAKING AND INSTALLING SAME

This application is a continuation of application Ser. No. 068,347, filed Aug. 21, 1979 which is in turn a continuation of Ser. No. 906,105, filed May 15, 1978 and Ser. No. 770,801, filed Feb. 22, 1977 all abandoned.

BACKGROUND OF THE INVENTION

This invention is directed to an erosion control device for preventing shoreline erosion in lakes and oceans. It also relates to a method of constructing and installing an erosion control device.

It is well known that a serious problem for riparian owners has been the loss of beaches and other property as a result of wave action in a body of water. Numerous attempts have been made in forming an erosion control structure which will prevent erosion at a reasonable cost. Such an erosion control structure must be able to withstand tremendous forces generated by storms, hurricanes, typhoons and the like.

Certain prior attempts at erosion control are exemplified by U.S. Pat. No. 2,191,924 issued on Feb. 27, 1940 to H. J. Humphrey; U.S. Pat. No. 2,474,786 issued on June 28, 1949 to H. J. Humphrey; U.S. Pat. No. 3,387,458, issued on June 11, 1968 to G. E. Jarian; and U.S. Pat. No. 3,894,397 issued on July 15, 1975 to Samuel S. Fair. Of these the Fair patent is most pertinent because applicants utilized that teaching, found it impractical, and developed this invention to avoid its deficiencies.

Specifically, the structure shown in the '397 patent includes rows and courses of concrete blocks which are longitudinally staggered from each other to provide divided flow passages. Subassemblies of three blocks are bonded together and then formed into a wall by using metal rods or straps to hold them together. This structure and assembly method proved deficient in the following respects. First, because the blocks are not tightly bonded to each other, sand and other entrained material may accumulate between them causing the rods or straps to ultimately give way, thereby destroying the structure. Moreover, wave action can cause the structure to separate longitudinally and cause it to fail. Second, the rods or straps must be put in place in the water, which creates assembly problems and limits the depth of water in which the structure may be built. Third, the straps are corrodable and are subject to failure over a long term simply as a result of rust or friction. Fourth, to provide for divided flow, adjacent rows of blocks may be offset only about 25% which does not maximize the horizontal strength of the structure. Moreover, the divided flow passages cannot be formed in a large cast structure. Fifth, there is no vertical overlap between rows and consequently vertical strength is not maximized. This invention eliminatos the aforementioned difficulties with that prior art structure.

SUMMARY OF THE INVENTION

The erosion control structure according to this invention is a wall preferrably formed from concrete that has undivided flow passages throughout its depth. The wall may be assembled from modules which are heavy enough to remain stable without being attached to each other, the ground, or some other supporting structures.

The modules may be made in a single casting or be constructed by assembling concrete blocks. When made from concrete blocks, the tops and bottoms of the blocks are bonded to each other with a suitable bonding agent. Preferrably, the blocks are bidirectionally offset by 50% to maximize the strength of the structure. The modules may then be placed in deep water by helicopter, crane, barge or some similar conveyance.

BRIEF DESCRIPTION OF THE DRAWINGS

The features of this invention will be further disclosed in the following detailed description of a preferred embodiment read in conjunction with the drawings in which.

DETAILED DESCRIPTION OF A PREFERRED EMBODIMENT

Figure 5:
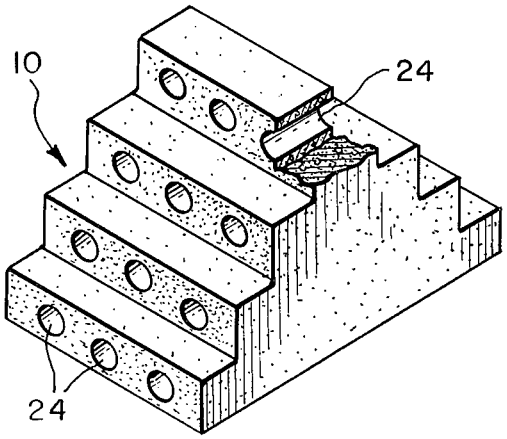
FIG. 5 is a perspective view of an alternative embodiment of the invention.

Referring now to the drawings, in which like reference numerals indicate like parts, a portion of a module (hereinafter referred to as the "module") is indicated generally at 10. In this embodiment the module 10 is formed from standard full concrete blocks 12 and half concrete blocks 14. However, it will be appreciated that the module 10 could be constructed in a single casting as is shown in FIG. 5.

The module includes a lower course 16 and an upper course 18. The lower course 16 is two blocks long and three blocks deep. The upper course 18 is also two blocks long, but is only two blocks deep. The bottoms of the upper course 18 are bonded with a resin 28 to the tops of the lower course 16. A suitable resin is "SIKASTIX" 340 which is available from the Sika Chemical Corporation.

Figure 1:
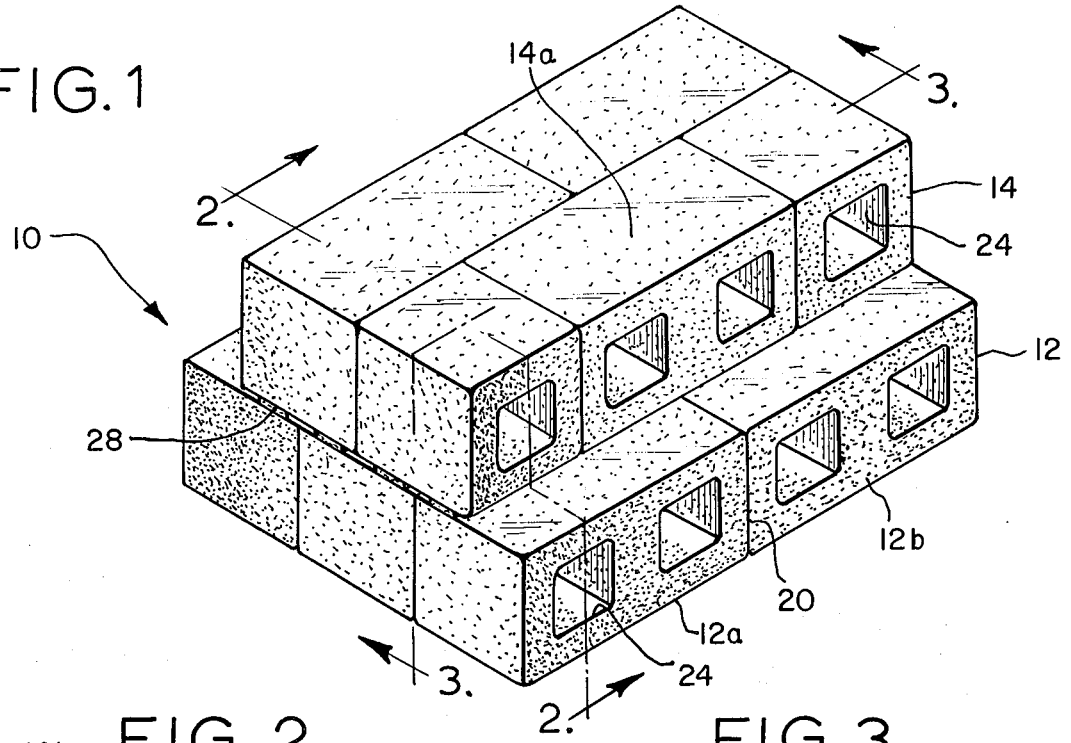
FIG. 1 is a perspective view of a portion of a module constructed in accordance with the principles of this invention.

The courses are both longitudinally and horizontally offset by 50% of the pertinent block dimension. Accordingly, the structure is extremely strong and only the tops and bottoms of the blocks need be bonded to each other. The longitudinal offset is best seen in FIG. 1 where the center of upper course block 14*a* is directly over the junction 20 of lower course blocks 12*a* and 12*b*. The horizontal offset is best shown in FIG. 2 where the center of upper course half block 11*b* is directly over the junction 22 of lower course blocks 12*b* and 12*c*.

Figure 2:
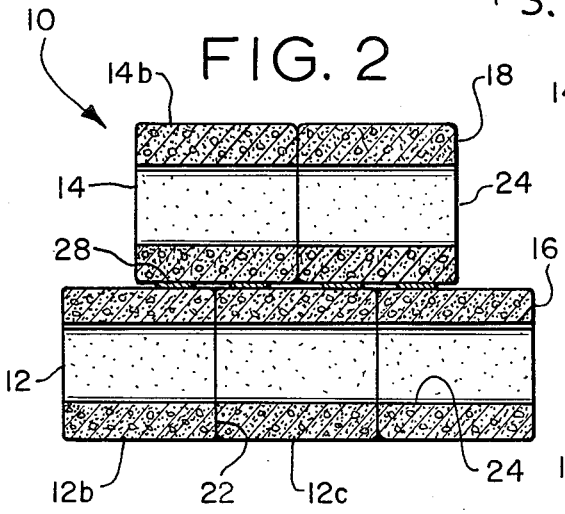
FIG. 2 is a front view of the structure shown in FIG. 1.
Figure 3:
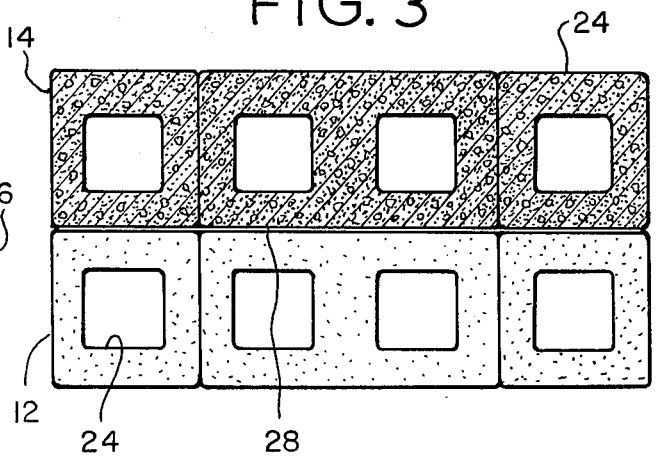
FIG. 3 is an end view of the structure shown in FIGS. 1 and 2.

This array of blocks forms undivided flow passage 24, shown in cross-section FIG. 2, through which water flows. When installed, the flow passages are positioned substantially perpendicular to the shoreline. As the water flows through the passages 24 its velocity is diminished and entrained sand and other materials are deposited on both sides of the module 10.

The flow passages are tubular, although their cross-sectional shape need not be circular. It has been found that the length of the flow passage must be at least twice the greatest cross-sectional dimension. Thus, if the flow passages are round in cross section, the length must be at least twice the diameter. If they are square in cross-section, the length must be at least twice the diagonal dimension.

The modules must be of sufficient weight to be stable in the conditions they will face. In general, they will be larger than the two course module shown in the Figures. However, the same assembly pattern would be utilized, regardless of size. The number of modules which are placed end to end will, of course, vary depending on the length of the installation involved.

As a specific example, an erosion control structure in accordance with this invention was formed in Lake Michigan from a plurality of modules. Each module consisted of four courses of standard concrete blocks. The first, lowermost course was three and one-half blocks long and six blocks deep. As used herein, length indicates a direction substantially parallel the shoreline and depth indicates a direction substantially perpendicular to the shoreline. The second course was three and one-half blocks long and five blocks deep. The third course was three and one-half blocks long and four blocks deep. And the fourth, uppermost course was three and one-half blocks long and three blocks deep. Each course was both longitudinally and horizontally offset as previously described. Each module weighed about 3500 pounds. About 50 modules were placed end to end by helipcopter to form an erosion control structure about 250 feet long.

The modules were about four feet deep along the lowermost course and about four feet high. They were placed parallel to the beach at point where the lake was from about 3½ feet deep to 7½ feet deep. The installation was about 50 feet from the existing shoreline. A mere seven months after installation, the shoreline was touching the structure nearly completely along its length. Shortly after installation a severe storm was present on the site and did not damage the installation. In contrast, a structure built in accordance with the '397 patent and located within 5 miles of the installation was substantially destroyed during that storm. In addition there was a significant build up of beach on the lakeward side of the installation constructed in accordance with this invention.

The modules can be of any size, but must be large enough to be stable without attachment to other supporting structures or to each other. The modules when placed end to end are preferrably slightly spaced from each other to prevent movement from abrading the modules and to prevent the formation of rip currents landward of the installation.

It has also been found that the stability of the structure is increased by installing it such that the longitudinal axes of the flow passages are angled with respect to water surface. The angle is such that the front or lakeward portion of the flow passage is lower than the rear or shoreward portion of the flow passage. In this manner the flow passage has a negative angle of attack with respect to the waves. The negative angle of attack may be achieved by the natural slope of the beach upon which the modules are installed or a portion may be added to the rear underside of the module to create the negative attack angle. In the case of a cast module the flow passages may simply be angled with respect to the bottom of the module.

Figure 4:
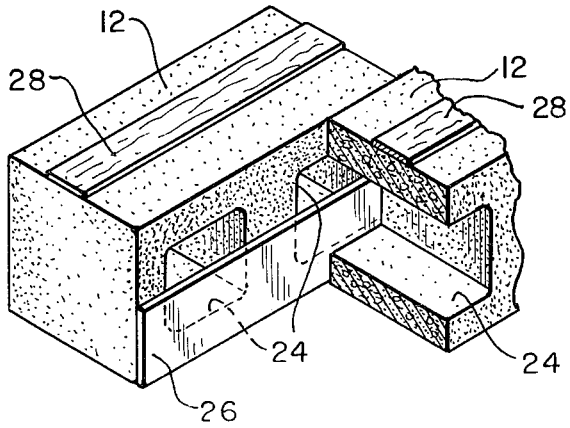
FIG. 4 is a cutaway perspective view of an alternate embodiment.

As shown in FIG. 4, it has been found that the erosion control characteristics of the module 10 may be improved by the use of flow restrictors. During construction a plate 26 may be bonded between adjacent blocks 12 to restrict the flow through the undivided passages 24. The exact placement of the restrictors depends upon the conditions present at the site. If placed near the end of the flow passage, they will reduce the erosion due to backward currents. If placed in the interior of the flow passage, they will speed up the accumulation of debris in the flow passage.

While the invention has been shown as being pyramidal along its depth, it need not be that particular shape. For example, it could be pyramidal along both its depth and length, and, if cast, could simply be rectangular.

Of course, the embodiments shown herein are not by way of limitation as other variations will readily occur to one of ordinary skill in the art.

We claim:

1. A method of protecting a shoreline from erosion comprising the following steps:

providing a plurality of integral concrete modules, each module having a front face, a rear face, and a bottom face, each module being pyramidal between its front and rear faces and having a size, shape, and weight to be stable, each module defining a plurality of aligned, undivided flow passages extending completely through the module from the front face to the rear face, at least one of said flow passages having a length at least twice as long as its height; then placing the plurality of modules in the water such that the modules are oriented in an array, each of said modules resting on its bottom face and, when emplaced, having no means of attachment to the underlying ground, other than the force of gravity acting on the module;

each module being located offshore in the water;

each module being oriented such that at least some of its flow passages are inclined with respect to the surface of the water to present a negative angle of attack with respect to incoming waves;

said array of modules effective to cause accretion of water borne material around the modules to protect the shoreline against erosion;

said array of modules free of rigid interconnections therebetween to allow differential settling and movement between adjacent modules in order to allow the array of modules to conform to the changing ground contour.

2. The method of claim 1 wherein the modules are placed at least 50 feet from the shoreline.

3. The method of claim 1 wherein the array is a line oriented substantially parallel to the shoreline.

4. The invention of claim 1 wherein all of the flow passages of all of the modules are oriented to present a negative angle of attack to incoming waves.

5. The invention of claim 1 wherein all of the flow passages are oriented perpendicular to the shoreline as viewed from above.

6. A method of protecting a shoreline from erosion comprising the following steps:

providing a plurality of integral concrete modules, each module having a front face, a rear face, and a bottom face, each module being pyramidal between its front and rear faces and having a size, shape, and weight to be stable, each module defining a plurality of aligned, undivided flow passages extending completely through the module from the front face to the rear face, at least one of said flow passages having a length at least twice as long as its height; then placing the plurality of modules in the water such that the modules are oriented substantially in a line parallel to the shoreline, each of said modules resting on its bottom face and, when emplaced, having no means of attachment to the underlying ground, other than the force of gravity acting on the module;

each module being located at a point in the water where more than 50 percent of its greatest vertical dimension is below the surface of the water;

each module being oriented such that its flow passages are oriented substantially perpendicularly to the shoreline as viewed from above and are inclined with respect to the surface of the water such that all of the flow passages of all of the modules present a negative angle of attack with respect to incoming waves;

said line of modules effective to cause accretion of water borne material around the modules to protect the shoreline against erosion;

said line of modules free of rigid interconnection therebetween to allow differential settling and movement between adjacent modules in order to allow the line of modules to conform to the changing ground contour.

7. The method of claim 6 wherein the modules are placed at least 50 feet from the shoreline.

8. An erosion control installation comprising:

an integral concrete module having a front face, a rear face, and a bottom face, said module being pyramidal between its front and rear faces and having a size, shape and weight to be stable, said module defining a plurality of substantially parallel, undivided flow passages extending completely through said module from the front face to the rear face;

said module installed at a site where beach erosion control is desired;

said module being disposed in the water resting on its bottom face and having no means of attachment to the underlying ground, other than the force of gravity acting on said module;

said module being located at a point in the water where more than 50 percent of its greatest vertical dimension is below the surface of the water; and said module being disposed such that the longitudinal axes of said flow passages are negatively inclined with respect to the surface of the water.

* * * * *